United States Patent [19]

Merry

[11] 4,147,122

[45] Apr. 3, 1979

[54] DECK CLEAT

[75] Inventor: Carl A. Merry, Marion, Mass.

[73] Assignee: Schaefer Marine Products, New Bedford, Mass.

[21] Appl. No.: 840,976

[22] Filed: Oct. 11, 1977

[51] Int. Cl.[2] ..... B63B 21/04

[52] U.S. Cl. ..... 114/218; 24/115 J; 114/204; 114/112

[58] Field of Search ..... 114/102, 111, 112, 113, 114/114, 204, 205, 218, 100; 24/129 R, 115 J, 115 K; 105/482; 248/499, 501, 502

[56] References Cited

U.S. PATENT DOCUMENTS

| | | | |
|---|---|---|---|
| 533,193 | 1/1895 | Granger | 114/218 |
| 2,453,357 | 11/1948 | Barkley | 114/111 |
| 2,891,490 | 6/1959 | Elsner | 105/482 |
| 3,678,876 | 7/1972 | Alter | 114/218 |
| 3,828,714 | 8/1974 | Perkins | 114/218 |

*Primary Examiner*—Trygve M. Blix
*Assistant Examiner*—D. W. Keen
*Attorney, Agent, or Firm*—Cesari and McKenna

[57] ABSTRACT

Disclosed is an improved deck cleat of the type that is mounted on a slide for repositioning along a slide track and wherein the improved construction is characterized by (1) a positioning lock such as a set screw, being placed between the legs of the cleat and (2) by the use of rigid threaded sleeves welded to the slide and serving to receive fasteners, such as screws, which fix the main structure of the deck cleat to the slide. This construction avoids stress being placed upon the fasteners during use of the cleat when stress is applied at the union of the cleat and its slide mechanism.

4 Claims, 2 Drawing Figures

DECK CLEAT

BACKGROUND OF THE INVENTION

This invention relates to an improved, adjustably positionable, deck cleat of the type used on boats and particularly on sailing boats.

In considering the discussion of the background of the invention appearing below, it is to be recognized that the discussion necessarily is presented with foreknowledge of the invention. Consequently, it is to be emphasized that some of the text discusses the invention in light of problems and other matters which were not considered by those skilled in the art as being relevant to the invention before the invention was made.

Deck cleats are well known hardware used on many kinds of boats. In some sailing craft it is often important to have a variable positioning capability for some deck cleats. To this end, there has been provided deck cleats which are suitable for mounting on elongated tracks. Such cleats are provided with a slide member which holds the cleat upon its track while it is moved along the track. When the cleat is in the desired position, a set screw which is mounted in the slide, is tightened to hold the deck cleat against the track in the predetermined position. For example, such a slidable cleat can be used on a racing boat as a blow cleat for mooring purposes and then be relocated out of the way when the boat is being raced.

Such devices have been relatively simple. However a number of problems can arise in the conventional construction of such devices. For example, the body of the cleat is normally connected to the slide by primary screws depending through the body of the cleat, into its base, and terminating in the slide portion of the apparatus. Consequently, bending moments applied to the cleat are borne to a substantial extent bythe screws. This can result in bending of the screws and damaging of their threads with consequent difficulty in removing the screws, difficulty in visually ascertaining whether the screws were properly tightened, and in some instances the cleat can pull away completely from its slide.

Another apparently heretofore unrelated and, perhaps, even unrecognized problem of the prior art is the conventional placement of the positioning/tightening device, usually a set screw, on the slide beneath one of the extremities of the cleat body. This placement has caused lines to catch on the cleat, the lines being jammed between set screw and cleat body.

Also, when making a line fast by taking turns about the cleat, the set screw prevents the line from nesting properly under the adjacent end of the cleat. Resultantly, at the very least, the line connection to the cleat is unsightly and unseamanlike. Also, if several turns are taken about the cleat, one or more bights may project out beyond the end of the cleat and slip off the cleat entirely when the line is tensioned in use thereby weakening the hitch.

SUMMARY OF THE INVENTION

Accordingly, it is a principle object of the invention to provide an improved adjustable line or rope anchoring device, e.g. a deck cleat.

Another object of the invention is to provide a deck cleat wherein fasteners used therewith are protected from premature wear and unnecessary stress.

A further object is to provide a slidable deck cleat which facilitates making lines secure.

A further object of the invention is to provide an adjustable deck cleat which is so designed as to discourage misuse thereof.

Yet another object is to provide a cleat such as this which is not prone to catch lines loose on deck.

Other objects of the invention will be clear to those skilled in the art upon their reading of this disclosure.

The above objects have been substantially achieved by constructing a slideable deck cleat whose locking means for fixing the position of the cleat on a track is positioned between two legs of the cleat around which a line is made fast. This construction protects the locking means, such as a lock nut or set screw, from physical abuse, and from being loosened inadvertently. It also prevents the locking means from interfering with the rope turns about the cleat since the locking means are located well within those turns. Moreover, being located underneath the cleat and between its legs, the locking means is in no position to catch and jam lines being moved along the deck adjacent to the cleat.

In the more advantageous embodiments of the invention, the slide and cleat are connected together by threaded fasteners that extend through the cleat legs and into strong, rigid sleeves fastened to, and projecting upwardly from, the slide into the cleat legs. The fasteners terminate at positions well above the connections of these sleeves to the slide. Thus most of the forces exerted on the cleat proper are transmitted to the slide by way of the sleeve rather than via the fasteners so that stresses on the threaded fasteners are avoided. Thus the slidable cleat of the invention is not only stronger than those used heretofore, but also its construction ensures a secure hitch and minimizes the chances of lines being caught inadvertently in the cleat.

ILLUSTRATIVE EMBODIMENT OF THE INVENTION

In this application and accompanying drawing there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

Figure 1:
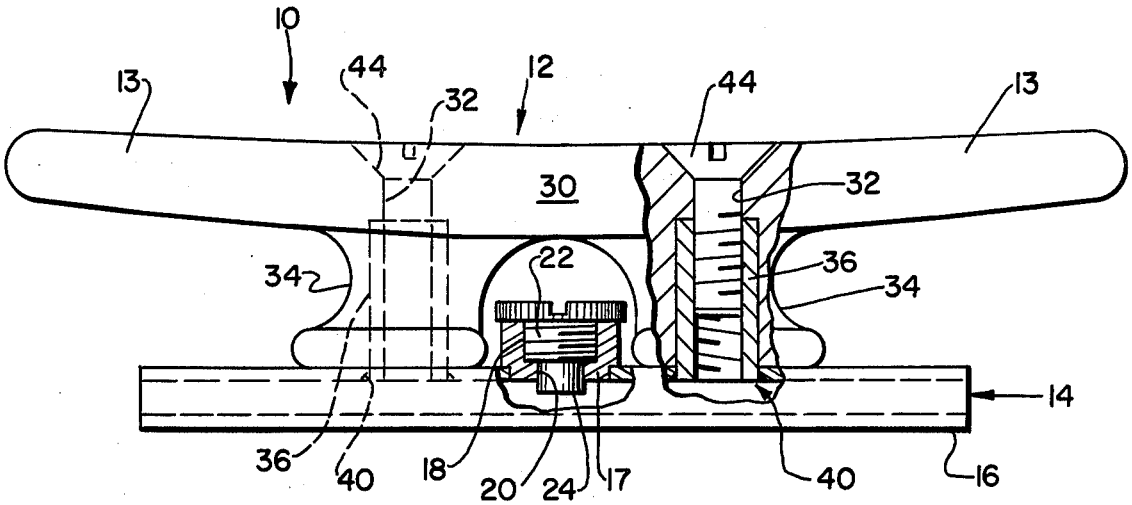
FIG. 1 is a side elevation, partially in section, of an adjustable deck cleat constructed according to the invention.

Referring to FIG. 1, it is seen that an adjustable deck cleat 10 comprises a cleat member 12 of the type having two oppositely extending arms 13 and is mounted on a slide assembly 14. Slide assembly 14 carries, in addition to a C-shaped slide element 16, a boss 17 defining an internally threaded cylinder 18 having an aperture 20 in the bottom thereof. A set screw 22 is received in boss 20 and may be turned so that the bottom portion 24 thereof bears against a track 26, as best seen in FIG. 2, thereby holding the slide assembly firmly in position on the track.

Cleat 12 has a body 30 and a pair of spaced apart depending legs or bases 34. Two apertures 32 are machined through the cleat body 30 and legs 34. The aperture portions in the legs are enlarged to receive a pair of strong, rigid, internally threaded sleeves 36 which extend from an upper position within the elongated cleat body 30 to a lower position at which they extend into and are welded to slide 14 at 40. The welds 40 are circumferential and thus assure a strong permanent connection of sleeves 36 to slide 14. The cleat body is removeably secured to the slide by flat-head screws 44 which extend down through apertures 32 in cleat body 30 and into the sleeves 36, terminating at the bottoms of those sleeves.

Thus, each connection of the cleat 12 to slide 14 consists of a post comprising a rigid sleeve 36 and internal screw 44 that extend from within the cleat body 30 toward slide 14.

Figure 2:
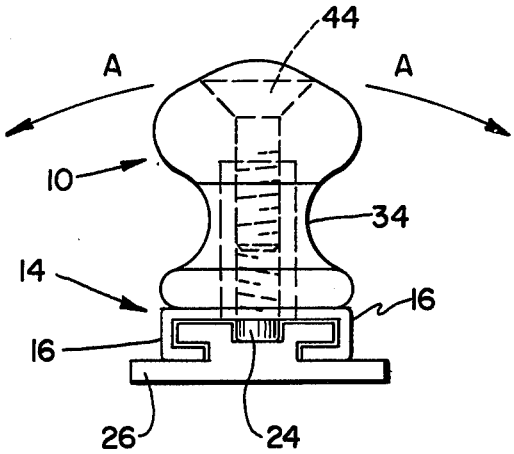
FIG. 2 is an end elevation of the deck cleat of FIG. 1.

Forces tending to cock the cleat as for example, indicated by the arrows A in FIG. 2 are transmitted to slide 14, not by way of screws 44, but via the rigid sleeves 36. This lack of stress of the screws translates directly to an ability of the cleat to take physical abuse without such damage as will weaken it and impair its function.

Further as best seen in FIG. 1, the boss 17 and set screw 22 are completely protected underneath the cleat body 30 and between legs 34. Therefore they are in no position to interfere with lines being turned about the cleat or to jam lines moving along the deck adjacent the cleat. By the same token, the cleat cannot be used improperly as a jam cleat. Consequently, the present cleat should prove to be a very safe and functional piece of marine hardware.

It is also to be understood that the following claims are intended to cover all of the generic and specific features of the invention herein described and all statements of the scope of the invention which might be said to fall therebetween.

What is claimed is:

1. In an adjustable rope-anchoring apparatus of the type having oppositely-extending arms mounted on a base comprising two legs, a slide member and a locking screw forming means adapted to tighten said apparatus onto a slide track, the improvement wherein said locking screw is mounted on said base between said legs.

2. Apparatus as defined in claim 1 wherein said arms and legs form a deck cleat and said slide member and legs are connected by means of threaded fasteners screwed into rigid sleeves fastened to, and projecting upwardly from said slide member into said legs of said deck cleat, said sleeves terminating at positions substantially above said slide member and said legs engaging said slide member so as to minimize bending forces on said fasteners when a load is applied to said cleat.

3. An adjustable deck cleat of the type adapted to slide along a track and comprising a cleat body having legs, a slide member, a connection between the cleat body and the slide member, and lock means to fix the position of said cleat on a track, the improvement wherein said connection comprises a pair of rigid internally threaded sleeves, means for connecting corresponding ends of said sleeve to said slide member at spaced-apart locations thereon, means defining passages extending from the ends of said cleat legs into said cleat body, the cross-sectional shapes of said passages corresponding to the cross-sectional shapes of said sleeves and being dimensioned to snugly telescopically receive said sleeves so that the ends of said cleat legs engage said slide member, means defining smaller sized passages extending from the top of said cleat body to the inner ends of said sleeve-receiving passages, and threaded fasteners extending through said smaller passages and screwed into said sleeves.

4. The cleat defined in claim 3 wherein said lock means comprises a locking screw engaged between said cleat legs and arranged to engage said track.

* * * * *